US011186999B1

(12) United States Patent
Ryan

(10) Patent No.: US 11,186,999 B1
(45) Date of Patent: Nov. 30, 2021

(54) MULTI-USE SUPPORT STAND

(71) Applicant: Joseph A. Ryan, Colorado Springs, CO (US)

(72) Inventor: Joseph A. Ryan, Colorado Springs, CO (US)

( * ) Notice: Subject to any disclaimer, the term of this patent is extended or adjusted under 35 U.S.C. 154(b) by 118 days.

(21) Appl. No.: 16/448,603

(22) Filed: Jun. 21, 2019

Related U.S. Application Data

(60) Provisional application No. 62/690,468, filed on Jun. 27, 2018.

(51) Int. Cl.
*E04G 1/20* (2006.01)
*E04F 21/18* (2006.01)
*E04H 17/06* (2006.01)
*E04G 1/15* (2006.01)

(52) U.S. Cl.
CPC ..... *E04F 21/1805* (2013.01); *E04G 1/15* (2013.01); *E04G 1/20* (2013.01); *E04H 17/06* (2013.01)

(58) Field of Classification Search
CPC ..... E04G 1/18; E04G 1/20; E04G 1/32; E04F 21/1805
See application file for complete search history.

(56) References Cited

U.S. PATENT DOCUMENTS 185,956 A * 1/1877 Park ..... E04G 1/20 182/146
653,768 A * 7/1900 Foreaker ..... E04G 1/20 182/146
1,471,304 A * 10/1923 Young ..... E04G 1/20 182/136
1,494,489 A * 5/1924 Jones ..... E04G 1/20 182/103
3,232,377 A * 2/1966 Smith ..... E04G 1/18 182/115
3,394,777 A * 7/1968 Glover ..... E04G 1/20 182/131
4,479,634 A * 10/1984 Blatz ..... B66F 7/10 248/354.5
5,365,860 A * 11/1994 Billington, III ..... A47C 9/025 108/108
6,827,181 B2 * 12/2004 Austin ..... E04G 1/32 182/150

(Continued)

*Primary Examiner* — Bradley Duckworth
(74) *Attorney, Agent, or Firm* — Edwin H. Crabtree; Ramon L. Pizarro

(57) ABSTRACT

A multi-use support stand used for holding various types of building materials and used in other types of construction projects. The support stand includes a horizontal foot brace and a horizontal cross brace attached to a bottom of a vertical support post. An oblique support post is attached to a top portion of the vertical support post and a portion of the foot brace. One end of a horizontal extension arm is attached to a sliding "U" shaped channel. The channel is received around a portion of the oblique support post. A pin is received in a selected pin hole in the side of the support post for securing the sliding channel to the oblique support post. When a first and second support stands are placed next to each other, the horizontal extension arms are used for holding loads of sheet rock, plywood, bench table top, working platform, shelving, footbridge sections, dimensional lumber, and other application specific items needing to be supported horizontally or an elevated obtuse angle.

9 Claims, 2 Drawing Sheets

(56) References Cited

U.S. PATENT DOCUMENTS

| | | | | |
|---|---|---|---|---|
| 6,840,350 | B2 * | 1/2005 | Deal | E04G 3/30 182/82 |
| 8,186,479 | B2 * | 5/2012 | Vieira | E04G 5/04 182/45 |
| 10,463,558 | B2 * | 11/2019 | Skursky | A61G 13/121 |
| 10,709,237 | B2 * | 7/2020 | Robinson | A47B 57/30 |

* cited by examiner

MULTI-USE SUPPORT STAND

This non-provisional patent application claims the benefit of the subject matter and the filing date of a provisional patent application, Ser. No. 62/690,468, filed on Jun. 27, 2018, and having a title "MULTI-USE SUPPORT STAND", by the subject inventor.

BACKGROUND OF THE INVENTION

(a) Field of the Invention

This invention relates to a support stand for holding and supporting various items, and more particularly, but not by way of limitation, to a multi-use support stand used in building construction, military foot bridges, fence post construction, and similar uses.

(b) Discussion of Prior Art

Heretofore, there have been a number of different types of support stands and related tools, such as a work bench, a saw horse, a scaffold, and different types and sizes of ladders, which are limited to either horizontal or vertical work applications. Some of these stands and work tools are permanently fixed and limited to a locked position. Also, these types of stands and tools can't be compressed or expanded into a work surface, to meet a basic job site need or a work place application. The subject invention solves the above mentioned work requirement, having unique structure, function and advantages as described herein.

SUMMARY OF THE INVENTION

In view of the foregoing, it is a primary objective of the subject invention to provide a multi-use support stand, which can be used in a variety of commercial and residential work place applications, such as a work bench, a saw horse, a scaffold, shelving, a fence post, furniture, solar panels and similar applications. Also the support stand can be use in a military application, such as a foot bridge.

The support stand is roughed in construction and can be made of heavy gauge metal tubing or a variety of material choices for meeting different performance requirements. Also, a pair of the of the stands are capable of vertically holding, at an angle, loads of sheet rock, plywood and the like, from 2000 to 3000 pounds and greater. The support stand can also come in different sizes from 4 to 6 feet in height and 3 to 4½ feet in width, from front to back being the most common range. Smaller and larger dimensions can be made to accomplish specific engineered applications.

Another object of the invention is the support stand is portable and can be quickly set up indoors and outdoors for various types of work applications.

The subject multi-use support stand includes a horizontal foot brace and a horizontal cross brace attached to a bottom of a vertical support post. An oblique support post is attached to a top portion of the vertical support post and a portion of the foot brace. A horizontal extension arm is attached to a sliding "U" shaped channel. The channel is received around a portion of the oblique support post. Pins are received in pin holes in the sides of the support post for securing the sliding channel to the oblique support post. When a pair of support stands are placed next to each other, the horizontal extension arms are used for holding loads of sheet rock, plywood, lumber, a bench/table top, a working platform, shelving, bar bells, footbridge sections, dimensional lumber and other application specific items needing to be supported horizontally or at an elevated obtuse angle.

These and other objects of the present invention will become apparent to those familiar with different types of building support stands when reviewing the following detailed description, showing novel construction, combination, and elements as herein described, and more particularly defined by the claims, it being understood that changes in the embodiments to the invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the subject multi-use support stand, and in which.

DESCRIPTION OF THE PREFERRED EMBODIMENTS

Figure 1:
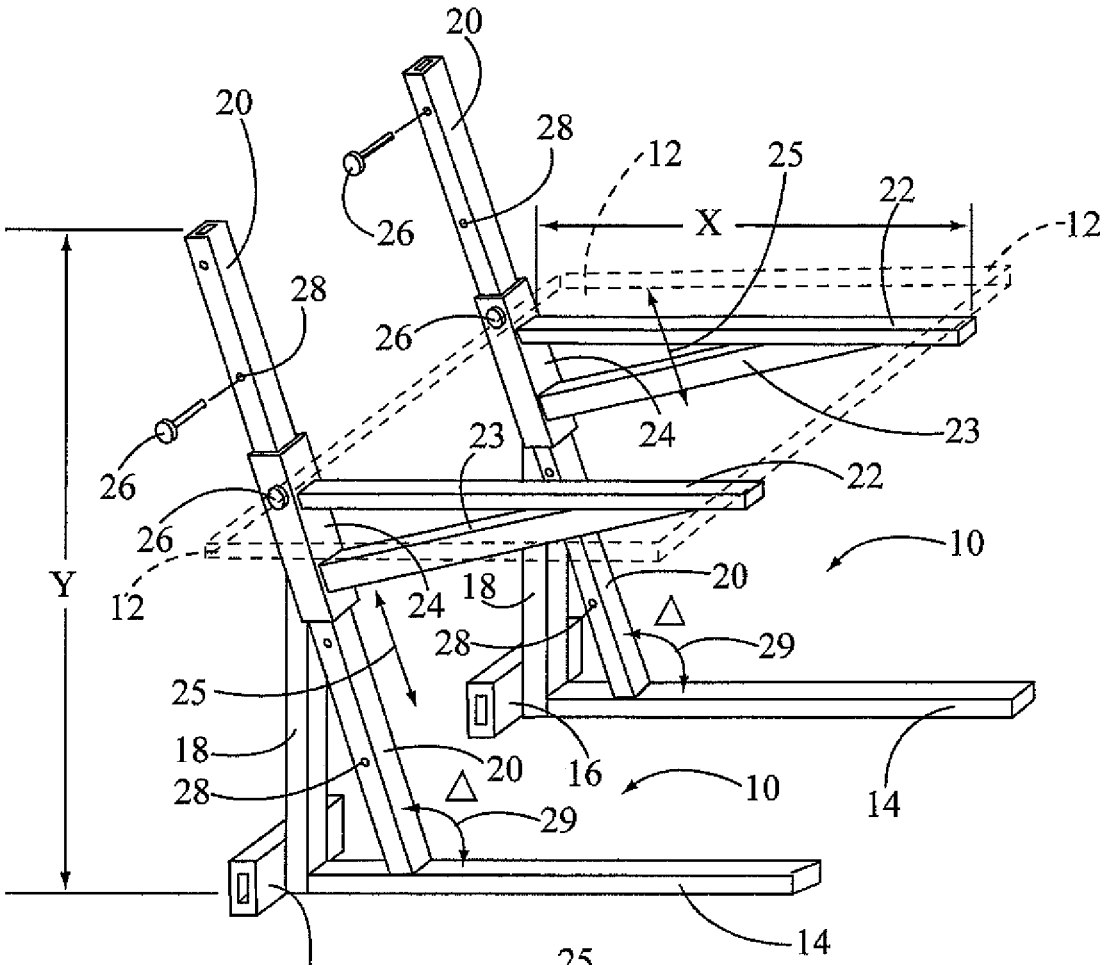
FIG. 1 is a perspective view of first and second support stands spaced apart and holding a sheet of plywood.

In FIG. 1, first and second multi-purpose support stands are shown disposed next to each other and having a general reference numeral 10. The support stands 10 are illustrated holding a sheet of plywood 12. The sheet of plywood 12 is shown in dashed lines.

Each of the support stands 10 include a horizontal foot brace 14 and a horizontal cross brace 16. The braces 14 and 16 are attached to a bottom of a vertical support post 18. An oblique support post 20 is attached to a top portion of the vertical support post 18 and a portion of the foot brace 14. One end of a horizontal extension arm 22 is attached to a "U" shaped channel 24. Also, the extension arm 22 is supported using an angled support tube 23 attached at one end to the bottom of the arm 22 and an opposite end attached to the channel 24.

The "U" shaped channel 24 is slidably received around a portion of the oblique support post 20 and along a length of the support post, as indicated by arrows 25. A pin 26 is received in a selected spaced apart pin hole 28 in the sides of the support post 20 for securing the channel 24 to the post 20. When there are a pair of spaced apart support stands 10, the horizontal extension arms 22 are used for holding loads of sheet rock, loads of plywood and other building products. The building products can be stacked one on top of each other horizontally or stacked next to each other at an angle on top of the horizontal extension arms.

The extension arms 22 can have a length "X" in a range of 2 to 4 feet. The oblique support post 20 can have a height "Y" in a range of 4 to 6 feet. Also, the oblique support post 20 can be at an angle "Δ" greater than 90 degrees up to 135 degrees, from the horizontal, as shown as arrow 29.

Figure 2:
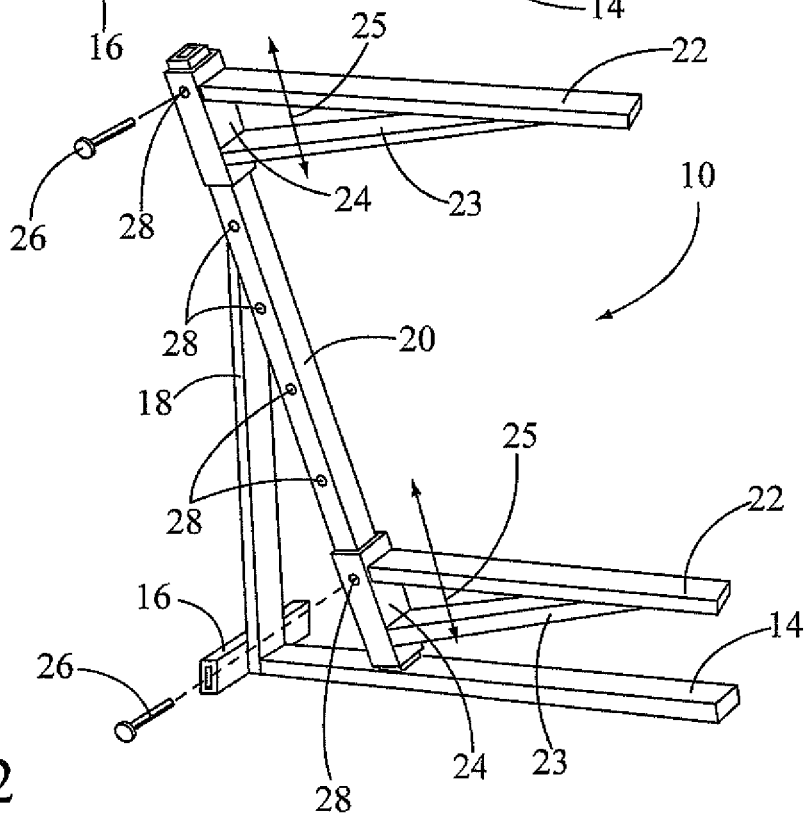
FIG. 2 is a perspective view of the first support stand with a pair of horizontal extension arms slidably mounted on an oblique support post.

In FIG. 2, a perspective view of the first support stand 10 is shown with a pair of horizontal extension arms 22 slidably mounted on the oblique support post 20. In this example of the support stand 10, the two horizontal pairs of extension arms 22 can be used for shelving and holding various construction materials or stored items.

Figure 3:
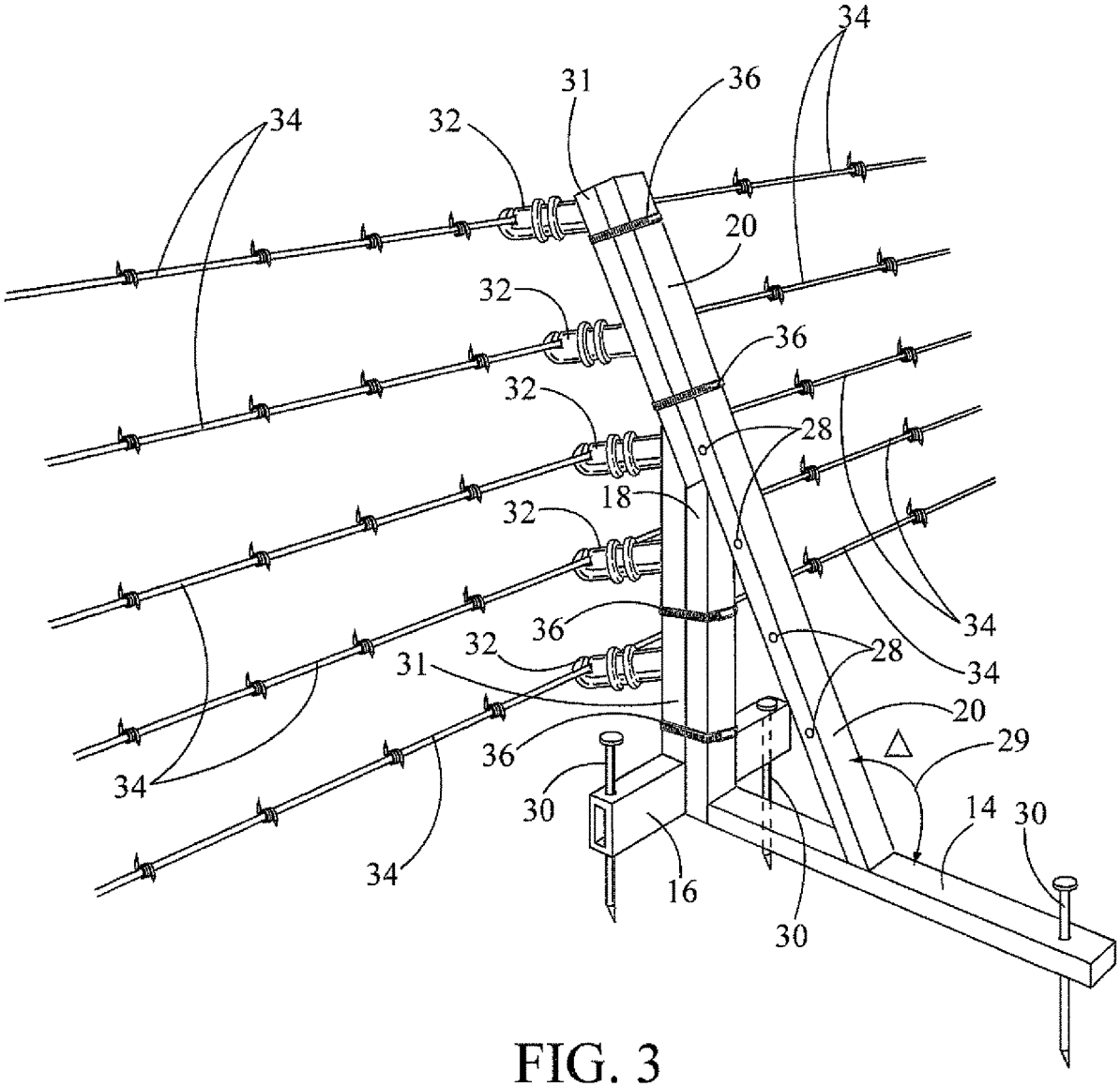
FIG. 3 is another perspective view of the first support stand used as a fence post with ground stakes and wire fence attachment arms for holding fence wire next to the oblique support post.

In FIG. 3, another perspective view of the first support stand 10 is illustrated and used as a fence post. Ground stakes 30 are used to secure the foot brace 14 and cross brace 16 to a ground surface. The support stand 10, in this example, includes 2 by 2 inch wood posts 31, attached to the back sides of the vertical support post 18 and the oblique support post 20, using hose clamps 30. The wood posts 31 are used to hold spaced apart glass wire insulators 32. In this drawing, the wire insulators 32 are shown holding fence wire 32 next to the support stand 10.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A multi-use first support stand and a spaced apart multi-use second support stand, each of the two stands used in conjunction with each other for holding a plurality of building materials thereon, the two support stands comprising:

a horizontal foot brace and a horizontal cross brace attached to a bottom of a vertical support post;

an oblique support post attached to a top portion of the vertical support post and a portion of the foot brace;

a first horizontal extension arm, one end of the first horizontal extension arm attached to a first sliding "U" shaped channel, the first sliding channel received around a portion of the oblique support post;

and a pin received in pin hole in the sides of the oblique support post for securing the first sliding channel and the second sliding channel to the oblique support post.

2. The support stands as described in claim 1 further including a second horizontal extension arm, one end of the horizontal extension arm attached to a second sliding "U" shaped channel, the second channel received around a portion of the oblique support post, and a pin received in a pin hole in the sides of the oblique support post for securing the second sliding channel to the oblique support post.

3. The support stands as described in claim 2 wherein the first and second extension arms have a width "X" in a range of 2 to 3½ feet.

4. The support stands as described in claim 1 wherein the oblique support post is disposed at an angle "Δ" greater than 90 degrees up to 135 degrees from the horizontal on a top portion of the vertical support post and a portion of the foot brace.

5. The support stands as described in claim 1 wherein the oblique support post has a height "Y" in a range of 4 to 6 feet.

6. A multi-use first support stand and a spaced apart multi-use second support stand, each of the two stands used in conjunction with each other for holding a plurality of building materials thereon, the two support stands comprising:

a horizontal foot brace and a horizontal cross brace attached to a bottom of a vertical support post;

an oblique support post attached to a top portion of the vertical support post and a portion of the foot brace;

a first horizontal extension arm, one end of the first horizontal extension arm attached to a first sliding "U" shaped channel, the first sliding channel received around a portion of the oblique support post;

a second horizontal extension arm, one end of the second horizontal extension arm attached to a second sliding "U" shaped channel, the second channel received around a portion of the oblique support post, the first horizontal extension arm disposed above the second horizontal extension arm on the oblique support post;

and pins received in pin holes in the sides of the oblique support post for securing the first sliding channel and the second sliding channel to the oblique support post.

7. The support stands as described in claim 6 wherein the oblique support post is disposed at an angle "Δ" greater than 90 degrees up to 135 degrees from the horizontal on a top portion of the vertical support post and a portion of the foot brace.

8. The support stands as described in claim 6 wherein the oblique support post has a height "Y" in a range of 4 to 6 feet.

9. The support stands as described in claim 6 wherein the first and second extension arms have a width "X" in a range of 2 to 3½ feet.

* * * * *